US005862863A

United States Patent [19]

Swisher

[11] Patent Number: 5,862,863

[45] Date of Patent: Jan. 26, 1999

[54] DUAL COMPLETION METHOD FOR OIL/GAS WELLS TO MINIMIZE WATER CONING

[76] Inventor: Mark D. Swisher, 213 Robert St., Jena, La. 71342

[21] Appl. No.: 704,955

[22] Filed: Aug. 26, 1996

[51] Int. Cl.[6] ..... E21B 43/12; E21B 43/14

[52] U.S. Cl. ..... 166/313; 166/50; 166/54.1; 166/370

[58] Field of Search ..... 166/50, 54.1, 68, 166/106, 313, 369, 370

[56] References Cited

U.S. PATENT DOCUMENTS

| | | | |
|---|---|---|---|
| 2,605,637 | 8/1952 | Rhoades | 166/313 X |
| 2,855,047 | 10/1958 | Widmyer | 166/313 X |
| 2,899,880 | 6/1959 | Hughes | 166/313 |
| 2,973,039 | 2/1961 | Payne, Jr. | 166/313 X |
| 3,039,535 | 6/1962 | Hathorn et al. | 166/313 X |
| 3,262,499 | 7/1966 | Fleming | 166/313 X |
| 3,326,292 | 6/1967 | Young et al | 166/54.1 X |
| 3,952,804 | 4/1976 | Smyrl | 166/313 X |
| 4,785,886 | 11/1988 | Renard | 166/370 |
| 5,127,457 | 7/1992 | Stewart et al. | 166/313 X |
| 5,145,004 | 9/1992 | Cornette | 166/313 X |

*Primary Examiner*—George Suchfield
*Attorney, Agent, or Firm*—John M. Harrison

[57] ABSTRACT

A dual completion method for oil/gas wells, which method is designed to prevent or at least minimize, coning of water in a hydrocarbon producing well. In a preferred embodiment the method includes the steps of perforating a common zone in the oil/gas well at vertically-spaced locations and producing water-free oil and/or other hydrocarbons through the upper perforations and the well annulus or tubing, as well as preferably hydrocarbon-free water from the bottom perforations through well tubing. Careful control of hydrocarbon and water production maintains a stable hydrocarbon and water contact in the formation and prevents coning of the water into the hydrocarbon and in some cases prevents coning of the hydrocarbon into the water. Production of hydrocarbon and water in this manner facilitates an equal pressure drop acting near the hydrocarbon/water contact in the well and formation to keep the water from rising in the formation. Accordingly, water is produced at a controlled rate lower in the formation to produce a pressure sink equal to that created by the hydrocarbon production at the top of the formation. Accordingly, hydrocarbons are produced with minimum water coning at a rate that maximizes profitability.

5 Claims, 6 Drawing Sheets

DUAL COMPLETION METHOD FOR OIL/GAS WELLS TO MINIMIZE WATER CONING

BACKGROUND OF THE INVENTION

1. Field of the Invention

This invention relates to coning control in oil/gas wells and more particularly, to a dual completion method of controlling the coning of water into hydrocarbons such as oil and gas by perforating a common producing oil strata or formation in vertically-spaced relationship above and below the oil-water interface in the formation and producing both the oil and water in a controlled manner separately from the well.

One of the problems encountered in oil and gas production over the years is the production of salt water in the well, a circumstance which increases operating costs and decreases revenue in most operating circumstances. The increased operating cost under such conditions is due to several factors, among which are the requirement for larger tubing and/or more expensive artificial pumping systems to handle the increased volume caused by water production with the oil and or other hydrocarbons to separate the water from the oil at the surface. The increasing water/oil ratios in the well production fluid lead to decreased oil/gas production, lower revenues and lower ultimate recoveries, in most cases and the problem is particularly acute in fields that are known for high water cut production. Most of these sands have a very strong natural water drive and many oil reservoirs have an oil-water contact zone with the water column characterized by up to 10 to 90 percent of the height. This condition leads to bottom water coning that takes place very rapidly due to the clean nature of many of the sands. For example, these clean sands are typically characterized by one to four darcy permeability and have very high vertical to horizontal permeability ratios.

2. Description of the Prior Art

Among the parameters which affect water coning in vertical oil wells are the mobility ratio, oil zone thickness, ratio of gravity forces to viscous forces, well spacing, ratio of horizontal permeability to vertical permeability and well penetration and production rate. While some of these variables are technically virtually uncontrollable, it has been found that water coning may be successfully controlled according to the technique of this invention. Accordingly, the dual completion method of this invention is designed to increase the hydrocarbon productivity as well as the amount of hydrocarbon ultimately recovered from the well. Efforts to explore methods and apparatus for controlling these variables in effecting a successful dual completion technique include computer simulations and production projections based on these simulations. The dual completion method of this invention was implemented with the following objectives in mind:

1. To prevent or minimize the coning of water into oil at hydrocarbon production rates exceeding computer model simulations, utilizing the dual completion method of this invention.
2. To produce oil and/or gas for an extended period of time at a production rate in excess of past sustainable rates of production from surrounding wells.
3. To produce oil directly to the collection tank without any treatment to remove water.
4. To produce salt water directly to a disposal system without any treatment to remove hydrocarbons.

5. To determine water coning characteristics of the particular sand under consideration and the economical benefits of the method of this invention.
6. To measure and compare hydrocarbon contamination of water from the method of this invention and compare this hydrocarbon contamination with like contamination in conventional systems.

Another object of this invention is to provide a new and improved method of controlling coning in hydrocarbon-producing wells, which method includes the steps of drilling a well through a hydrocarbon-producing interval to a selected depth or reworking an existing well, perforating the producing interval above and below the hydrocarbon-water contact zone in the formation and producing both hydrocarbons and water from the spaced perforations in the well at a controlled rate. This technique facilitates production of hydrocarbons such as oil and water in a stable oil-water condition which maximizes the wells' profitability.

SUMMARY OF THE INVENTION

These and other objects of the invention are provided in a new and improved dual completion method for producing oil wells, which method includes the steps of reworking an existing wellbore or drilling a well through a hydrocarbon-producing interval, strata or zone to a selected depth; setting casing and one or more production tubing string in the well; providing one or more packers in the well approximately at the hydrocarbon-water contact interval in the well casing; perforating the casing and interval, both above and below the packer or packers; and producing oil and/or other hydrocarbons through the annulus between the casing and the tubing or through a string of tubing and water through a separate string of tubing at a controlled rate, such that hydrocarbon and water production is maintained at constant controllable rates to minimize coning of the water into the hydrocarbon.

BRIEF DESCRIPTION OF THE DRAWINGS

The invention will be better understood by reference to the accompanying drawings, wherein.

DESCRIPTION OF THE PREFERRED EMBODIMENTS

Figure 1:
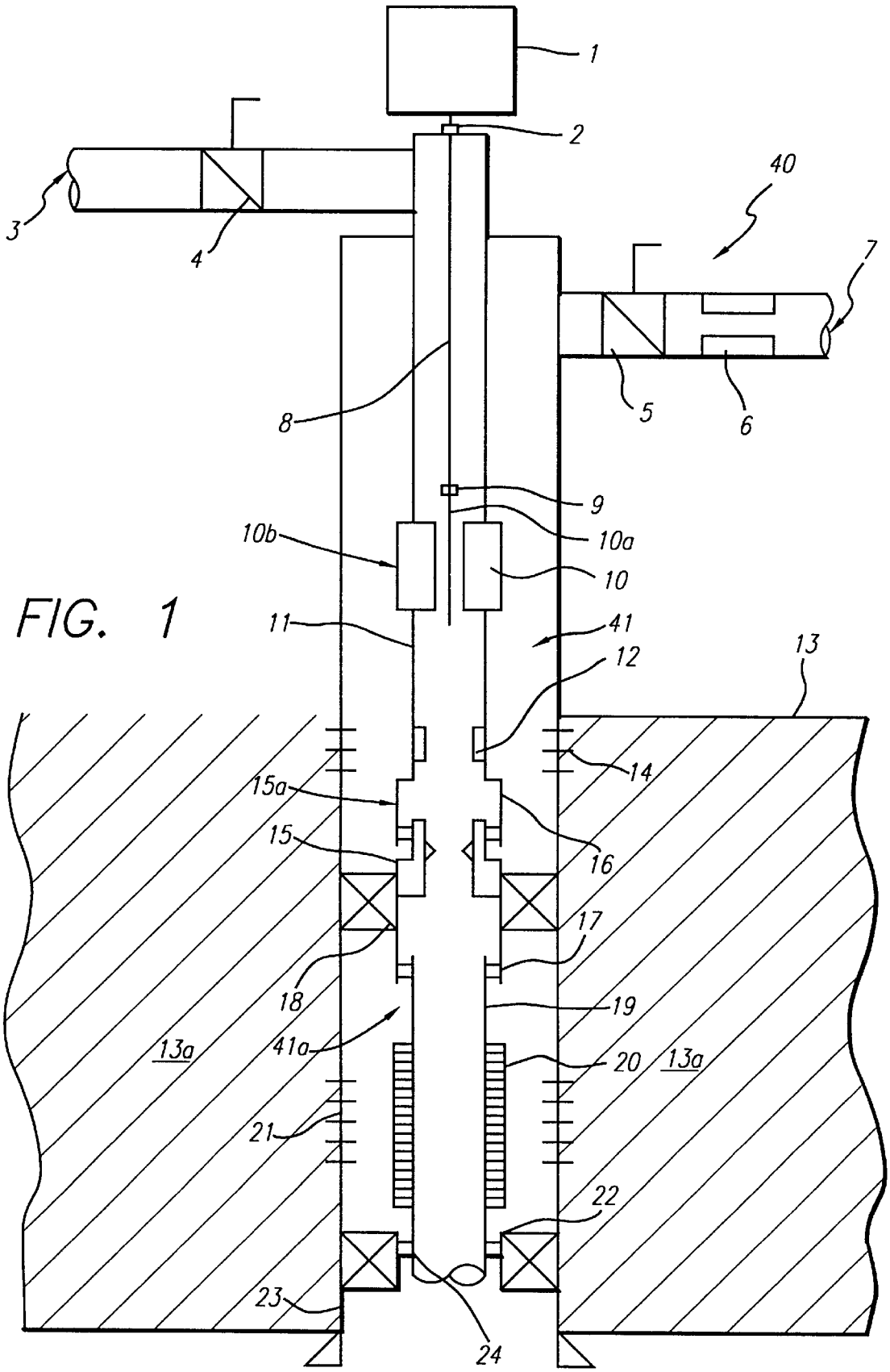
FIG. 1 is a schematic diagram for an oil well complete with casing and tubing, illustrating a first preferred embodiment of the dual completion method for oil wells of this invention suitable for testing the viability of the invention as an acceptable completion in the oil industry.

Referring initially to FIG. 1 of the drawings, in a first preferred embodiment of the invention, equipment for producing hydrocarbons and water from vertically-spaced areas is provided in a well 40. Optional production casing 23 is installed in the well 40 after drilling through a production interval or formation 13*a*, as illustrated. The formation top 13 of the formation 13*a* is indicated and hydrocarbon perforations 14 are provided in conventional fashion in the production casing 23 and extend into the formation 13*a* at a selected point below the formation top 13. In like manner, water perforations 21 are provided in the production casing 23 and formation 13*a* in spaced relationship with respect to the hydrocarbon perforations 14 and are located above a gravel pack sump packer 22, fitted with an anchor latch 24. An upper packer 18 is also provided in the well 40 below the hydrocarbon perforations 14, as further illustrated in FIG. 1. A water production tubing 11 is also extended into the well 40 in conventional fashion and terminates approximately at the gravel pack sump-packer 22, in order to seal the annulus 41 extending throughout the well 40 between water production tubing 11 and the production casing 23. Accordingly, it will be appreciated from a consideration of FIG. 1 that the upper packer 18 serves to block the annulus 41 from the gravel pack and screen 20 area, or lower annulus 41*a*. The gravel pack and screen 20 is provided in the lower annulus 41*a*, opposite the water perforations 21 to facilitate filtering sand from water flowing from the formation 13*a* through the water perforations 21, into the lower annulus 41*a* and through the gravel pack and screen 20, into the water production tubing 11. The on-off assembly bottom 15 and on-off assembly top 16 define an on-off assembly 15*a*, which is designed to receive a plug (not illustrated) and facilitate removal of the top string of water production tubing 11 above the on-off assembly bottom 15 without removing the bottom string of water production tubing 11 below the on-off assembly top 16.

An overshot 17 engages a gravel pack hook-up nipple 19 immediately below the on-off assembly 15*a* to facilitate a seal to prevent production of gravel pack sand. A sliding sleeve 12 is provided in the water production tubing 11 to facilitate selectively porting the water production tubing 11 and circulating fluids through the well as deemed necessary. A drive head 1 is provided at the surface of the well 40 and engages a sucker rod string 8, extending through the water production tubing 11, as further illustrated in FIG. 1. A pump rotor connector 9 connects the down-hole end of the sucker rod string 8 to the pump rotor 10*a* of a pump 10*b*, having a pump stator 10. Accordingly, operation of the pump 10*b* effects rotation of the sucker rod string 8 in the drive head 1 and pumps water flowing into the gravel pack and screen 20 and up the water production tubing 11. The water production line 3 is further fitted with a water wing valve 4 and water pumped through the water production line 3 is stored in a tank or other facility (not illustrated). Similarly, the pressure of the formation 13*a* typically forces hydrocarbons in the formation 13*a* to flow through the hydrocarbon perforations 14 and the annulus 41 between the water production tubing 11 and the production casing 23, into the hydrocarbon production line 7 through the hydrocarbon wing valve 5 and the hydrocarbon production line choke 6, to a storage facility (not illustrated). The hydrocarbon production line choke 6 is designed to restrict the flow of hydrocarbon through the hydrocarbon production line 7 for purposes of controlling oil/gas production rate.

Figure 2:
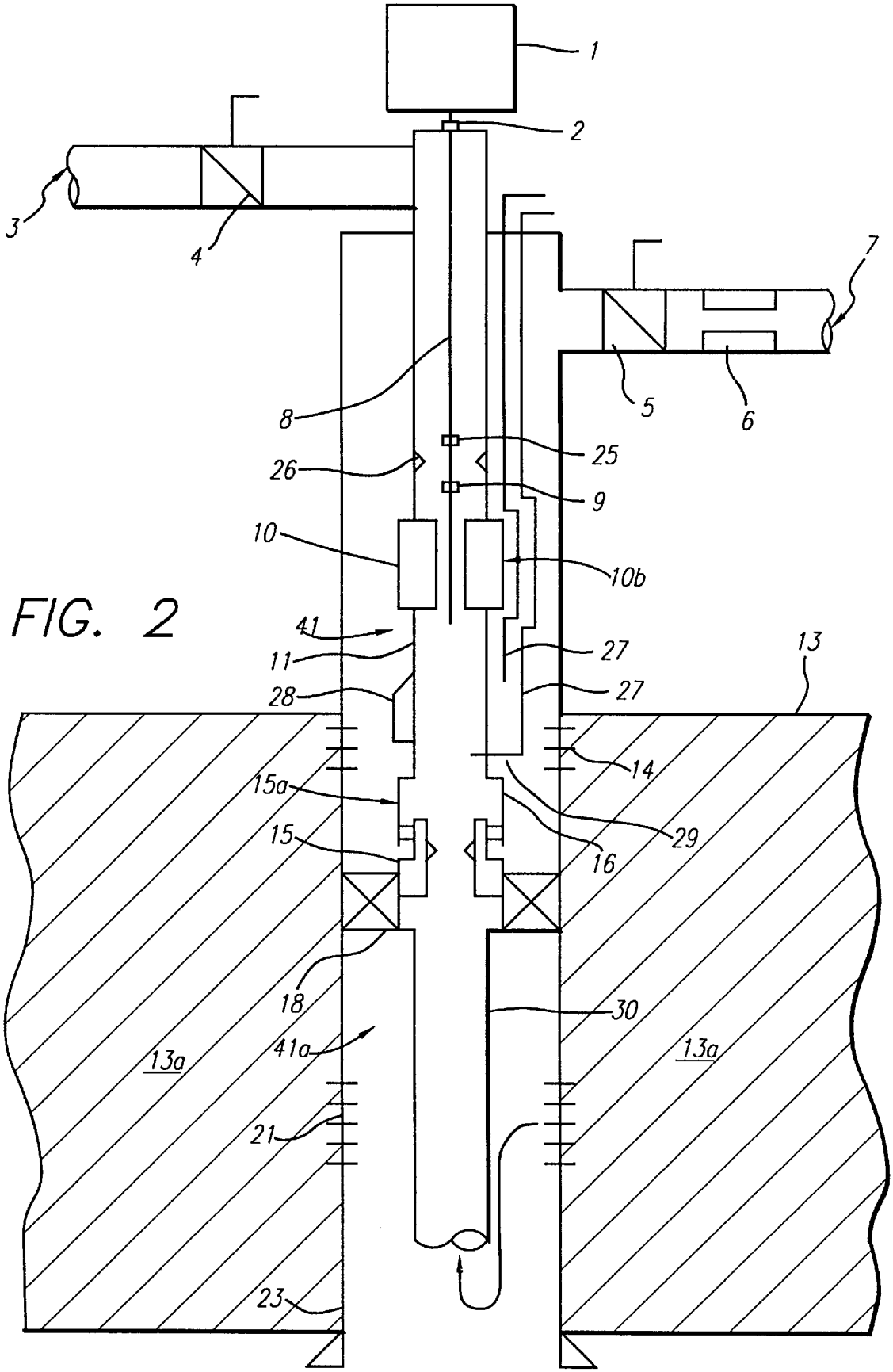
FIG. 2 is a schematic diagram of an oil well complete with casing and tubing and particularly illustrating a second preferred embodiment of the dual completion method for oil wells of this invention.

Referring now to FIG. 2 of the drawings the gravel pack and screen 20, illustrated in FIG. 1 of the drawings, has been removed and an injection tubing 27 and injection sub 29 added to the well 40 for injecting chemicals into the well 40, as deemed necessary. Furthermore, a sucker rod guide 25 is positioned on the sucker rod string 8 and a sucker rod collar 26 is provided in the water production tubing 11 to prevent inadvertent separation of all or part of the sucker rod string 8 from the drive head 1 and loss of the sucker rod string 8 in the well 40. Accordingly, in a most preferred embodiment of the invention the diameter of the sucker rod guide 25 is larger than the opening which remains in the production tubing 11 at the sucker rod collar 26, to achieve this purpose. As in the case of the well 40 illustrated in FIG. 1, water produced from the formation 13*a* through the water perforations 21 in the production casing 23 is pumped by means of the pump 10*b* from the annulus 41*a* through the tubing tailpipe 30 and the water production tubing 11 into the water production line 3, as heretofore described with respect to FIG. 1 of the drawings. The sliding sleeve 12 of FIG. 1 has been replaced with a ported mandrel 28, illustrated in FIG. 2. The ported mandrel 28 can be fitted with various choke sizes, so that hydrocarbon can be produced with the water up the water production tubing 11, in the event that pressure in the formation 13*a* is insufficient to flow the hydrocarbon to the surface. Production rates of hydrocarbon and water can be controlled by varying the choke sizes in the ported mandrel 28 and the on-off assembly bottom 15. Under conditions which allow the hydrocarbon to flow up the annulus 41 without the need of a pump, the ported mandrel 28 is plugged and the on-off assembly bottom 15 is open. These plugs and chokes (not illustrated) can be set using conventional wireline tools running inside the water production tubing 11, so that the water production tubing 11 need not be pulled from the well 40 to adjust these control elements.

Figure 3:
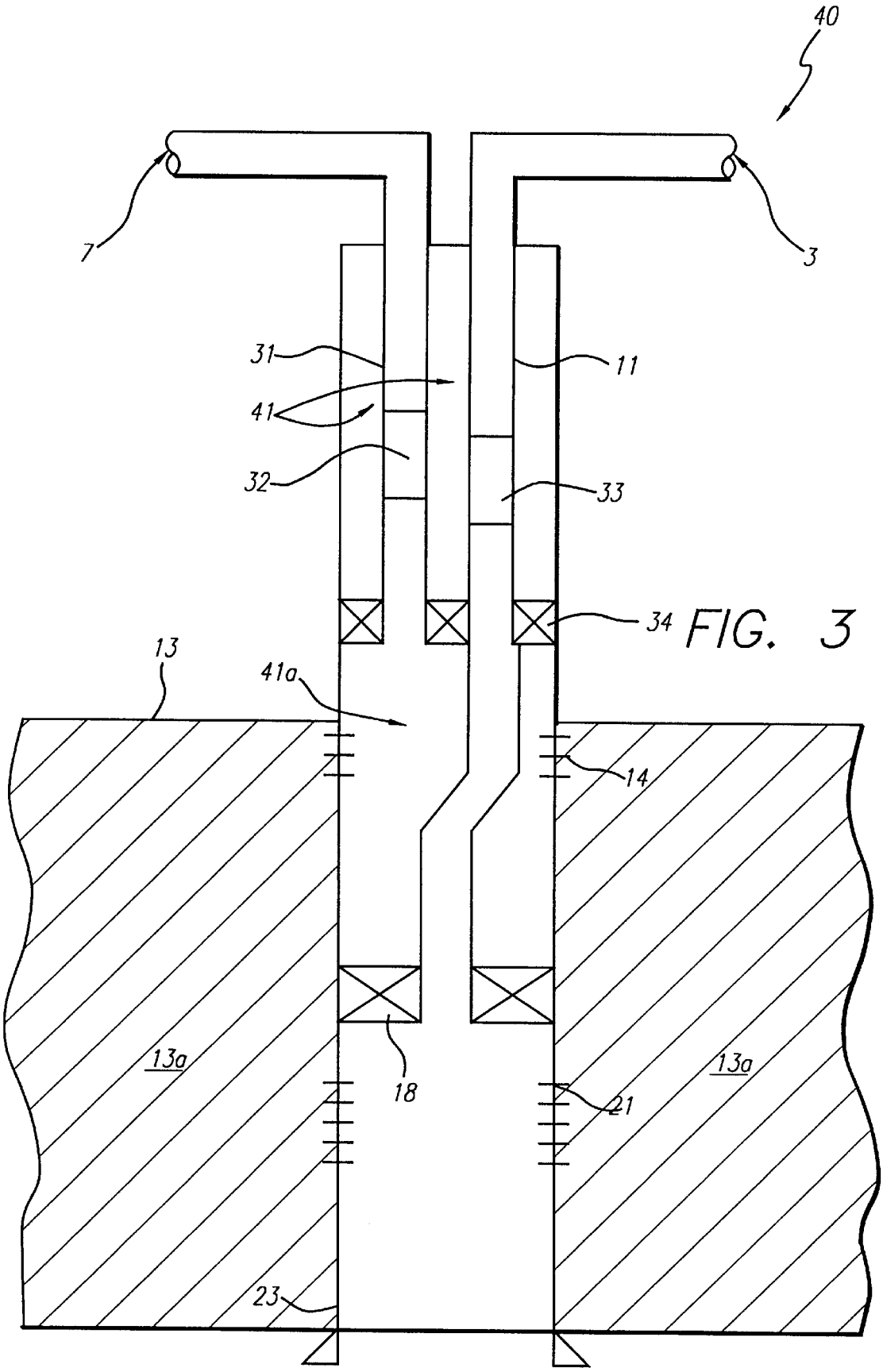
FIG. 3 is a schematic diagram of an oil well complete with a third embodiment of the invention incorporating dual tubing.

Referring now to FIG. 3 of the drawings, the well 40 is fitted with both water production tubing 11 and hydrocarbon production tubing 31, as illustrated. A dual isolation packer 34 is provided in the annulus 41 between the respective water production tubing 11 and hydrocarbon production tubing 31 to seal the annulus 41, as further illustrated in FIG. 3. Furthermore, a conventional hydrocarbon pump 32 is fitted in the hydrocarbon production tubing 31 and a conventional water pump 33 is provided in the water production tubing 11 for pumping hydrocarbons and water, respectively, through the hydrocarbon production tubing 31 and the water production tubing 11 as the hydrocarbon is delivered from the formation 13*a* through the hydrocarbon perforations 14 and the water is delivered from the formation 13*a* through the water perforations 21 in the production casing 23. Accordingly, the packer 18 serves to channel the flow of water from the water perforations 21 through the water production tubing 11, while the dual isolation packer 34 serves to channel the hydrocarbons produced through the hydrocarbon perforations 14 from the annulus 41*a* into the hydrocarbon production tubing 31. The water is delivered to the water production line 3 and the hydrocarbons to a corresponding hydrocarbon production line 7, as heretofore described with respect to FIGS. 1 and 2 of the drawings.

Figure 4:
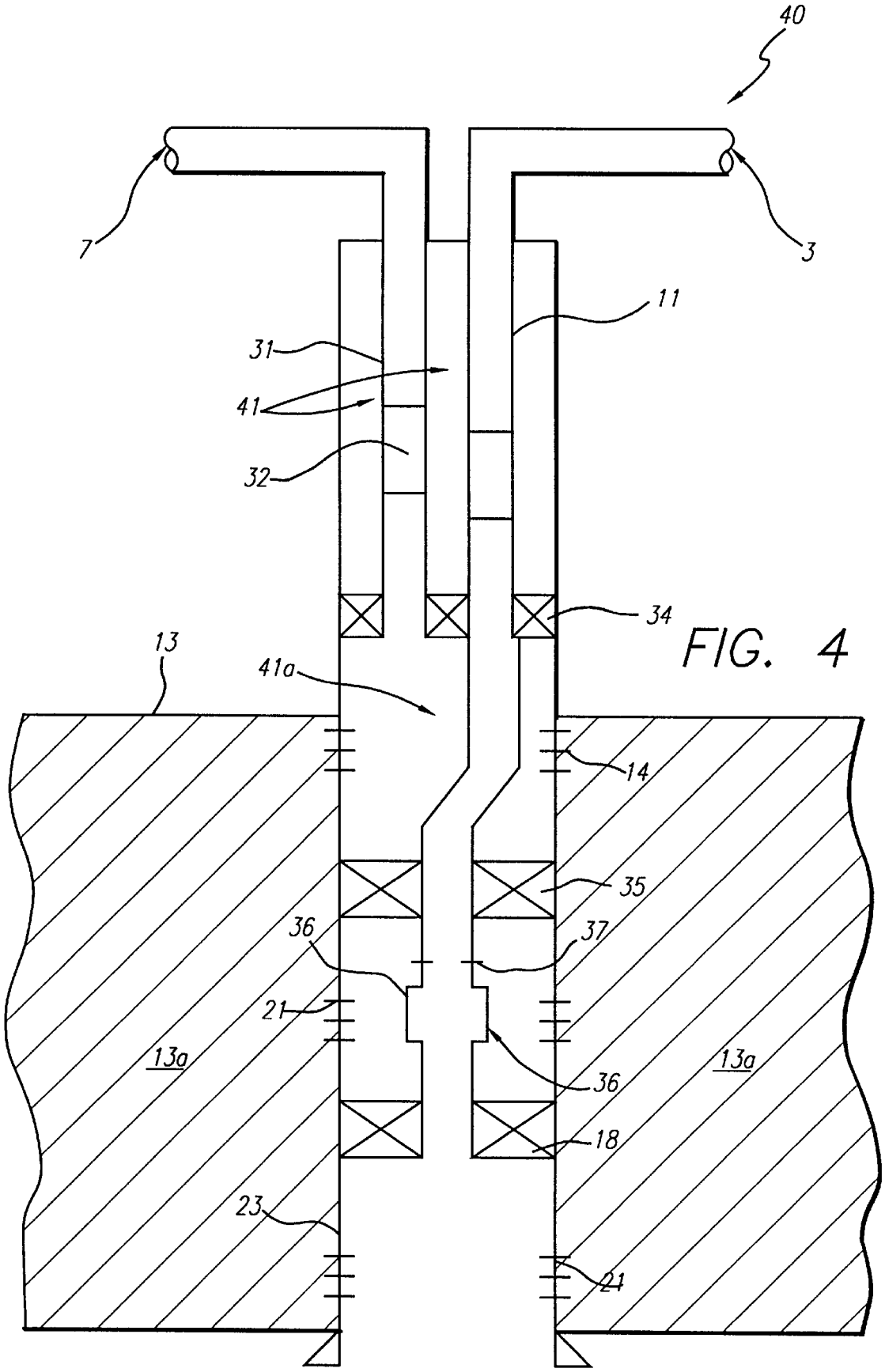
FIG. 4 is a schematic diagram of an oil well complete with a fourth embodiment, also incorporating dual tubing and designed to facilitate downhole disposal of water without producing the water to the surface.

Referring now to FIG. 4 of the drawings, in a still further preferred embodiment of the invention the well 40 is equipped with an additional set of disposal perforations 21*b*, located below the packer 18, to facilitate water discharge from the formation 13*a* without producing water to the surface. Furthermore, tubing intake ports 37 are provided immediately above a downhole pump 36, also positioned in the water production tubing 11 between the isolation packer 35 and the packer 18, to facilitate the flow of water from the formation 13*a* through the water perforations 21 located between the isolation packer 35 and the packer 18 and subsequently, into the water production tubing 11 through the tubing intake ports 37. This water is pumped downhole into disposal perforations 21*b* in order to reduce the energy required to produce water to the surface of the well 40 and/or provide increased water withdrawal rates from water perforations 21. The downhole pump 36 can be equipped to separate minute amounts of hydrocarbon and deliver them to the surface of the well 40 through the water production tubing 11. This feature of increasing water production allows the producer to increase the hydrocarbon flow rate without excessive coning. As in the case of the well 40 illustrated in FIG. 3, both a hydrocarbon production tubing 31 and the water production tubing 11 are provided in the well 40 to faciliate production of water as described above, as well as hydrocarbons from the hydrocarbon perforations 14 of the formation 13*a* through the hydrocarbon production tubing 31 and into the hydrocarbon production line 7, as described above with respect to FIG. 3. However, should the pressure in the formation 13*a* be sufficient to flow hydrocarbons without use of a hydrocarbon pump 32, then the hydrocarbon production tubing 31 and dual isolation packer 34 may be eliminated.

Figure 5:
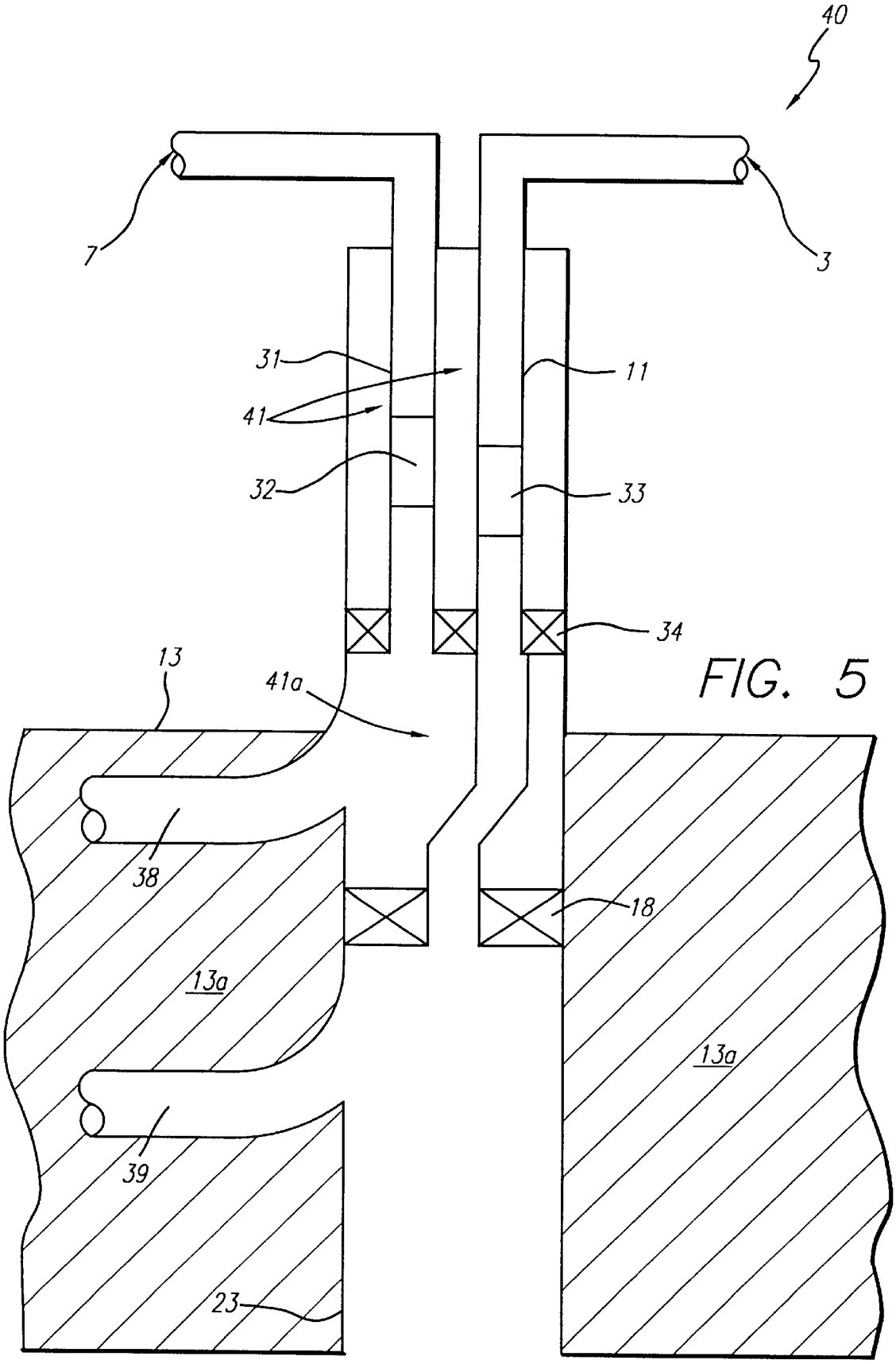
FIG. 5 is a schematic diagram of an oil well complete with a fifth embodiment incorporating dual tubing, with hydrocarbon and water feed laterals completed using horizontal drilling techniques.

Referring now to FIG. 5 of the drawings, in still another preferred embodiment of the invention the well 40 may be provided with a water production tubing 11 isolated from a hydrocarbon production tubing 31 by means of a packer 18. A hydrocarbon lateral 38 and a water lateral 39, located beneath the hydrocarbon lateral 38 are also provided, as illustrated. The hydrocarbon lateral 38 and the water lateral 39 may be drilled according to conventional techniques well known to those skilled in the art, such as use of a "whipstock" or the like. Accordingly, hydrocarbons are introduced into the well 40 through the hydrocarbon lateral 38, which extends into or through the formation 13*a*, as illustrated. Similarly, water is introduced into the well 40 through the water lateral 39, as illustrated. The hydrocarbons are pumped, if pumping is necessary, from the well 40 through a hydrocarbon production tubing 31 to a hydrocarbon production line 7 by means of a hydrocarbon pump 32, as heretofore described, whereas water is pumped from the well 40 through the water production tubing 11 and into the water production line 3 for storage, as also heretofore described. Alternatively, the water can be disposed downhole through the disposal perforations 21*b*, as heretofore described with respect to FIG. 4.

It will be appreciated by those skilled in the art that the dual completion method for producing oil/gas wells of this invention is versatile, in that various techniques may be utilized in a single vertically-oriented well bore to effect the flow of hydrocarbons and water into the well bore at vertically-spaced intervals and production of the hydrocarbons and the water in selected proportions to prevent water coning into the hydrocarbon or hydrocarbon coning into the water. The completion may utilize a single string of tubing or dual tubing, as heretofore described, and may utilize a downhole hydrocarbon pump under circumstances where the formation pressure is insufficient to force the hydrocarbons into the surface for collection.

Operation of the dual completed well in an attempt to prevent coning of water into the hydrocarbons and hydrocarbons into the water, is described in the following example:

The objectives heretofore stated were realized in the completion of a test well in the Top of Wilcox sand at 2500 feet in the Nebo Hemphill field located in LaSalle Parish, La. Oil in this field is produced from the Wilcox Sands that are well known in the area for their high-water cut production. Most of these sands have very strong natural water drives and many oil reservoirs have an oil-water contact, with the water column making up to ten to 90 percent of the height. This leads to water bottom coning that takes place very rapidly due to the clean nature of many of the sands. These clean sands have 1–4 darcy permeability and a very high vertical to horizontal permeability ratio. As drilled, the new test well encountered 18 feet of oil column above 64 feet of water column. Seven inch casing was set as the production string and 3½ inch tubing was used in the completion because of the large water/oil production ratio that would be needed to prevent coning. The permeability in the upper part of the sand where the oil perforations would be located was 2100 to 3500 (md). The permeability 10 feet below the oil water contact was 4200 to 4600 md. Because the sand was highly unconsolidated, the lower water sink perforations had to be gravel packed and a HEC pill was spotted ten feet below the oil water contact to help prevent the sand from sloughing after perforation was accomplished. A sump packer was set below the perforations and the well was then perforated with twelve shots per foot (spf) over a five foot interval. The gravel pack assembly was run in the hole and stung into the sump packer in conventional fashion. The water-sink perforations were acidized with HCL to clean up the perforations and gravel packed with 20/40 sand. The gravel pack packer was then pulled from the hole.

After various measures were taken to correct problems in preparing the well for production, the test well was perforated in the oil pay of the formation 13*a* and flowed up through the tubing on a choke (not illustrated). The flowing tubing pressure gradually dropped from 100 psi to 0 psi after several hours of producing at 2–4 barrels per hour of oil. Oil was then reversed down the casing to bring up any sloughing sand from the tubing string and keep the casing annulus full of clean oil. After several oil circulations throughout the first day of production, the well began to clean up and by the second day it was flowing four barrels per hour with 110 psi flowing tubing pressure on a 14/64 inch choke. The test well cleaned up to a 0.2% bottom sediment and water (bs&w). At this point, the tubing was ready to be lowered onto the on-off tool to isolate the tubing from the casing annulus.

After other production problems were encountered and solved, the test well was cleaned up and the tubing was lowered and latched on the on-off tool. The rotor of the progressive cavity pump was run in the hole with one-inch rods and the water drainage perforations were put on production. After three days of producing 1450 barrels of water per day up the tubing, the casing annulus was opened to a test tank to begin oil production from the top set of oil perforations. The test well was potentialled at 48 barrels of oil per day and 1472 barrels of water per day, one week after starting the oil production.

During the first six weeks of production the oil rate remained steady at 35–45 barrels of oil per day with 0.1% bs&w and only a trace of sand and a 120 psi flow casing pressure on an 8.5/64 inch choke. The oil flowed directly to the stock tank, where it was sold and the drainage water was produced to the existing salt water system for disposal.

After six weeks the test well was treated for corrosion by pumping and displacing inhibiter down the tubing string. This upset in the equilibrium caused the flow line casing pressure to drop from 120 psi to 110 psi. In subsequent weekly treatments the casing pressure continued to drop after each treatment until a water-cut of 6% was established in the oil production. It was determined that since the formation had such high permeability, the small upset caused by pumping into the water zone while the oil zone was producing, led to the oil/water contact rising.

Figure 6:
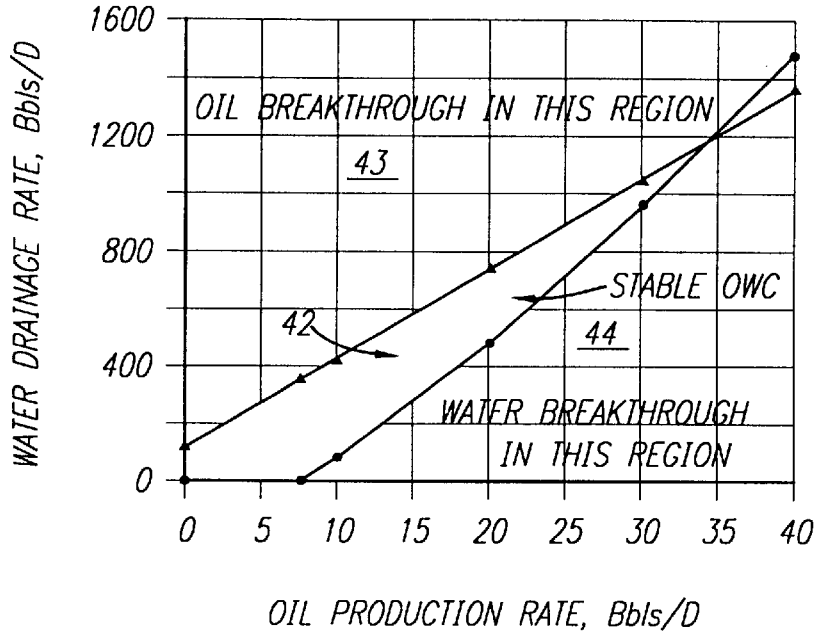
FIG. 6 is a prior art graph plotting oil production rate versus water drainage rate thus defining a production performance window.

To reverse the cone, corrosion treatments were discontinued and the water rate was increased to 1700 barrels per day. After several weeks the casing pressure rose from 80 psi back to 120 psi, and the bs&w content in the oil dropped back to 0.1%. Accordingly, the oil-water contact was effectively controlled and it was decided to vary the oil and water rates to increase well productivity and develop a performance profile based on a greater oil production rate than the computer-generated performance window 42, illustrated in FIG. 6, was capable of predicting.

As the oil production rate was increased above the critical values shown in the computer-generated performance window 42, the system became unstable and water production had to be increased to prevent upward coning of the water into the oil. However, this adjustment eventually led to oil coning downwardly into the water perforations 21, and the water stream eventually began to produce 500 to 800 ppm oil. Since separation equipment was already being used in the field, it was decided to continue producing at higher oil and water rates for economic reasons. In order to produce an excess of 40 barrels of water per day without water intrusion into the hydrocarbon perforations 14, the water drainage rate was increased to 2000 barrels of water per day. This was a 50:1 water-to-oil ratio and was necessary in order to bring the oil-water contact back down. The test well was produced at oil rates as high as 70 barrels of oil per day, but it was found at these high rates the system was so unstable that water intrusion into the hydrocarbon perforations 14 would occur, even at a water drainage rate of 2800 barrels of water per day, which approached the maximum pumping capacity of the well. After several months of varying choke sizes and flow rates, it was determined that the test well responded best to an oil flow rate of 55–60 barrels of oil per day with a water drainage rate of 2600 barrels of water per day, which was considerably higher than the computer simulation represented in FIG. 6.

After 17 months of production the test well was flowing 57 barrels of oil per day with 120 psi flowing casing pressure on a 9/64-inch choke and pumping 1900 barrels of water per day from the water drainage perforations. After the system stabilized for several months the water production was lowered without causing any water breakthrough into the oil perforations. The producing water/oil ratio was 33:1.

Figure 7:
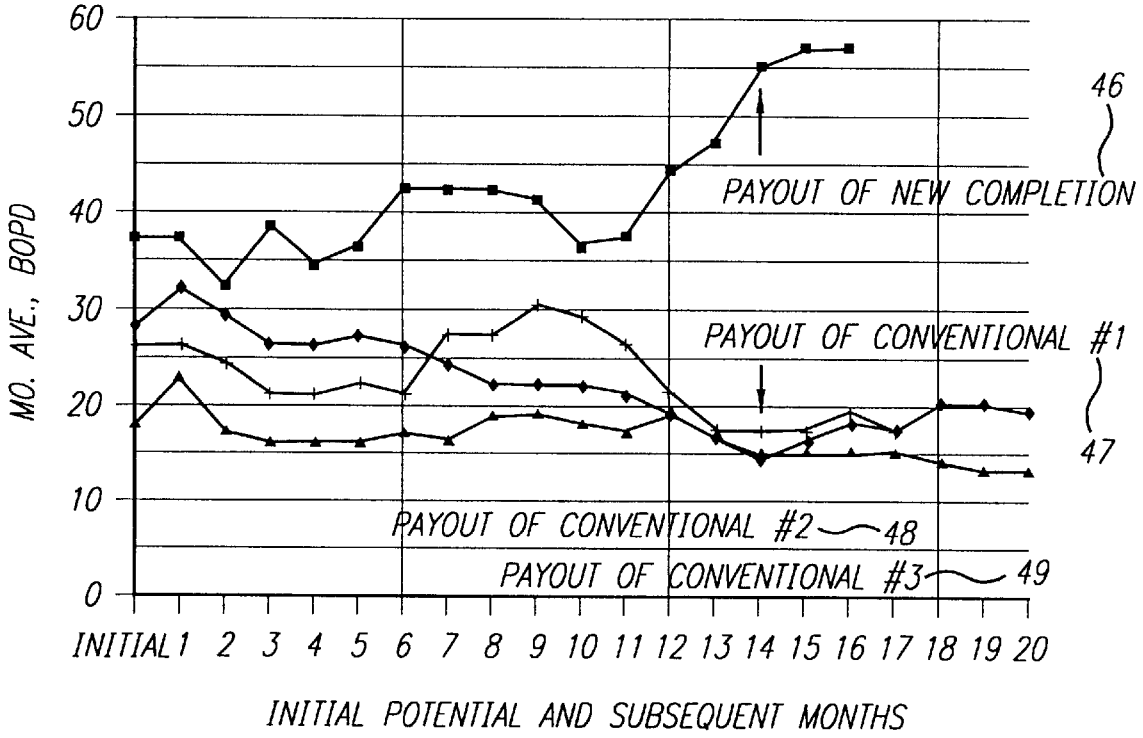
FIG. 7 is a graph of well operation according to the dual completion method of this invention compared to three conventional wells.

A comparison of oil production rates between the completion of this invention and three existing conventional completions is illustrated in FIG. 7, which plots the monthly barrels of oil per day average of the payout 46 of the new completion well 40 and well payouts 47, 48 and 49 of conventional wells nos. 1, 2 and 3 versus initial potential and subsequent months. The three conventional wells represented in the graph as nos. 1–3, were drilled in 1989 and encountered equal or greater oil column as compared to the well 40. As is typical with wells in this sand, all three conventional completions declined during their first two years of production as water coned into the oil perforations. In contrast, the new completion method of this invention produced more than the initial rate, even after 17 months of production in the well 40.

In another preferred embodiment of the invention, and referring again to FIG. 2 of the drawings, the operation of the well shows that it is possible to discharge drainage water directly from the tailpipe 30 of the well 40 into the well 40, without treatments to remove hydrocarbons. Accordingly, this discharge may be effected down the well bore itself rather than pumped upwardly into a collection tank or discharge area, as desired.

The objectives heretofore outlined were achieved by the method of this invention according to the following results:

1. It was successfully shown that the completion method of this invention facilitates optimal production of hydrocarbons from wells by controlling the rate of flow of oil and water to prevent coning.
2. The test well described in the example produced at a rate of 35–65 barrels of oil per day with two-tenths of one percent bs&w for over two years without water coning into the oil or oil coning into the water in unacceptable quantities.
3. Oil from the completion of this invention flowed directly to the stock tanks without the necessity of separating water from the oil.
4. Water was produced by the completion of this invention directly to the salt water disposal system without the necessity of additional separation of oil from the water.
5. The completion of this invention facilitated the adjustment of oil flow rates above the performance window predicted by the computer simulation, which describes only stable behavior of the system. Accordingly, payout of the test well occurred earlier than conventional wells and the well was flowing 55 barrels of oil per day vs. 15–25 barrels of oil per day normally achieved from conventional completions at payout, as illustrated in FIG. 7.
6. The completion of this invention was an environmental success since the level of oil in the water produced from the completion was below the detection level of the EPA approved test before increasing the oil and water rates above the stable performance window 42.
7. After an extended period of adjusting hydrocarbon and water flow rates and maximum profitability, the test well was deemed to be an economic success. After producing for two years, the test well was "pulled" due to a hole in the water production tubing 11 and subsequently returned to production after workover. The completion was considered to be viable and useful using the technique of the invention.

While the preferred embodiments of the invention have been described above, it will be recognized and understood that various modifications may be made in the invention and the appended claims are intended to cover all such modifications which may fall within the scope and spirit of the invention.

Having described my invention with the particularity set forth above, what is claimed is:

1. A method of dual completion of hydrocarbon wells having a well bore extending through a hydrocarbon formation, said method comprising the steps of:

providing at least one hydrocarbon opening extending from the well bore into the hydrocarbon formation for flowing substantially hydrocarbons from the hydrocarbon formation into the well bore;

providing at least one water-controlling opening extending from the well bore into the hydrocarbon formation below the hydrocarbon perforation for flowing substantially water from the hydrocarbon formation into the well bore;

providing a string of water production tubing in the well bore;

providing a water pump in said water production tubing for pumping water from the well through said water production tubing;

providing a ported mandrel in said water production tubing for pumping hydrocarbons from the hydrocarbon formation at a controlled rate and producing the hydrocarbons through said water production tubing; and positioning a packer in the well bore between said hydrocarbon opening and said water-controlling opening against the water production tubing for isolating said water production tubing to said water opening and pumping the water through said water production tubing at a water flow rate sufficient to substantially prevent coning of water into the hydrocarbons in the well.

2. The method according to claim 1 comprising the step of providing a water production on-off assembly in said water production tubing for selectively removing a top string of said water production tubing from the well.

3. The method according to claim 1 comprising the step of providing a gravel pack and screen in the well against said water production tubing for screening sand from the water flowing through said water opening into said water production tubing.

4. The method according to claim 3 comprising the step of providing an on-off assembly in said water production tubing for selectively removing a top string of said water production tubing from the well.

5. A method of dual completion of hydrocarbon wells having a well bore extending through a hydrocarbon formation, said method comprising the steps of:

providing at least one hydrocarbon lateral extending from the well bore into the hydrocarbon formation for flowing substantially hydrocarbons from the hydrocarbon formation into the well bore;

providing at least one water-controlling lateral extending from the well bore into the hydrocarbon formation below the hydrocarbon perforation for flowing substantially water from the hydrocarbon formation into the well bore;

providing a string of water production tubing in the well bore;

providing a water pump in said water production tubing for pumping water from the well through said water production tubing;

providing a ported mandrel in said water production tubing for pumping hydrocarbons from the hydrocarbon formation at a controlled rate and producing the hydrocarbons from said water production tubing; and positioning a packer in the well bore between said hydrocarbon lateral and said water-controlling lateral for isolating said water production tubing to said water-controlling lateral and pumping water through said water production tubing at a flow rate sufficient to substantially prevent coning of water into the hydrocarbon lateral of the well.

* * * * *